United States Patent [19]

Higashinakagawa et al.

[11] Patent Number: 4,827,178

[45] Date of Patent: May 2, 1989

[54] IMAGE DISPLAY TUBE

[75] Inventors: Emiko Higashinakagawa, Kawasaki; Michihiko Inaba, Yokohama; Yasuhisa Ohtake, Fukaya; Masaharu Kanto, Taishi, all of Japan

[73] Assignee: Kabushiki Kaisha Toshiba, Kawasaki, Japan

[21] Appl. No.: 777,758

[22] Filed: Sep. 19, 1985

[30] Foreign Application Priority Data

Sep. 21, 1984 [JP] Japan ..... 59-196851

[51] Int. Cl.[4] ..... H01J 29/07; H01B 1/02

[52] U.S. Cl. ..... 313/402; 313/407; 252/513; 252/512; 420/584

[58] Field of Search ..... 313/402, 404, 407, 408; 252/513, 519, 512; 420/584, 581, 585, 586, 44, 46, 582, 109, 45, 48, 50; 445/36, 47; 428/596; 148/DIG. 143, 327, 335

[56] References Cited

U.S. PATENT DOCUMENTS

| | | | |
|---|---|---|---|
| 3,895,939 | 7/1975 | Brooks et al. | 420/584 |
| 3,900,315 | 8/1975 | Vogt et al. | 420/584 |
| 4,547,338 | 10/1985 | Grobner et al. | 420/584 |
| 4,713,576 | 12/1987 | Misumi et al. | 313/402 |

FOREIGN PATENT DOCUMENTS

| | | |
|---|---|---|
| 0101919 | 3/1984 | European Pat. Off. . |
| 2231101 | 12/1974 | France . |
| 17-25446 | 12/1942 | Japan . |
| 50-58977 | 5/1975 | Japan . |
| 50-68650 | 6/1975 | Japan . |

*Primary Examiner*—Josephine Barr

*Attorney, Agent, or Firm*—Foley & Lardner, Schwartz, Jeffery, Schwaab, Mack, Blumenthal & Evans

[57] ABSTRACT

An image display tube constructed by use of in-tube parts comprising an alloy constituting essentially of (i) at least one of 0.5 to 4% by weight of Ti, 0.1 to 3.0% by weight of Al, 0 to 1% by weight of C, 0 to 5% by weight of Co, 0 to 12% by weight of Mo, 0 to 5% by weight of W, 0 to 4% by weight of Mn, 0 to 3% by weight of Si, 0 to 2% by weight of Be, 0 to 0.5% by weight of Cu, 0 to 0.1% by weight os S, 0 to 2% by weight of Nb and 0 to 2.0% by weight of Zr, (ii) 30 to 45% by weight of Ni, (iii) 3 to 15% by weight of Cr and (iv) a balance consisting essentially of Fe; thermoelasticity coefficient of the alloy being within the range of $\pm 20\times 10^{-6}/°C$. In the color image display tubes according to this invention, no color deviation is perceived all over the screen and thus a high-quality image is obtained.

11 Claims, 4 Drawing Sheets

IMAGE DISPLAY TUBE

BACKGROUND OF THE INVENTION

This invention relates to an image display tube (or a picture tube) which provides a high-quality display image and which is composed of in-tube parts such as a shadow mask, a frame and an inner shield comprising a permanent-elasticity alloy (hereinafter "Elinvar alloy") excellent in moldability and thermal properties.

An image display tube generally has a structure shown in FIG. 1. In this structure, a neck portion 2 constituting one end portion of a glass outer surrounder 1 is provided with, for example, an in-line electron gun 3, and a face portion 4 constituting the other end portion of the glass outer surrounder 1 opposite to the electron gun 3 is provided on the inner surface thereof with a fluorescent surface 5 on which red, blue and green fluorescent substances are sectionally arranged. A shadow mask 6 having a number of beam openings is disposed adjacent to and opposite to the fluorescent surface 5. This shadow mask 6 is fixed to a frame 7 with the interposition of an engaging tool 8, and this frame 7 is provided with an inner shield 9 so as to block the influence of earth magnetism.

In the image display tube thus constituted, electron beams 11 irradiated from the electron gun 3 are deflected by a deflecting device 10 disposed around a root section of the neck portion 2, pass through the openings in the shadow mask 6, and hit against the fluorescent surface 5 in order to generate fluorescents, thereby forming an image thereon.

In this case, the shadow mask 6, the frame 7 and the inner shield 9 have good etching properties and moldability, and are made from a material such as rimmed steel or aluninum killed steel, on a surface of which there can easily be formed oxide membrane capable of reducing the reflection of the electron beams. However, in order to satisfy requirements for a variety of recent communication media, higher quality of the image receiving tubes is required, in other words, it is required that the displayed image is easy to watch and is extremely fine. As a result, it is getting inconvenient to use the shadow mask 6, the frame 7 and the inner shield 9 comprising the above-mentioned rimmed steel and aluminum killed steel.

That is, when the image display tube is operated, temperature of the respective parts will rise up to a level of 30° to 100° C., and a strain will occur, for example, on the molded shadow mask owing to the thermal expansion of these parts and finally the so-called doming will appear thereon. As a result, relative deviation of the shadow mask from the fluorescent surface will take place, so that color deviation called "purity drift" (PD) will appear there. Particularly in the case of the high-quality image display tube, since the diameter and pitch of the openings in the shadow mask are very small, the aforesaid deviation will be relatively great, which fact will cause the in-tube parts comprising the above-mentioned rimmed steel and aluminum killed steel to become impracticable. In particular, the high-curvature type image receiving tube in which the reduction in the strain of images and the reflection of external lights is intended will bring about this problem remarkably.

Accordingly, it has heretofore been proposed, for example, in Japanese Patent Publication No. 25446/1967 and Japanese Unexamined Patent Publication Nos. 58977/1975 and 68650/1975 to use an Ni-Fe alloy having a small thermal expansion coefficient, for example, an invar (36Ni-Fe) as a formation material for this type of in-tube parts. Even in such Fe-Ni alloy, however, its temperature has risen owing to the bombardment of electrons and a color deviation has consequently occurred, which fact has elucidated that such a proposed technique is insufficient to heighten the quality of the image display tubes.

SUMMARY OF THE INVENTION

This invention has been achieved under such situations, and its object is to provide an image display tube which has simplified structure and a nearly plane screen and which can give extremely fine and clear high-quality images having less color deviation.

This invention is characterized by an image display tube in which at least one of the in-tube parts such as a shadow mask, an inner shield and a frame comprises an Fe-Ni-Cr alloy having a thermoelasticity coefficient in the range of $\pm 20\times 10^{-6}$/°C., and thus the constituted image receiving tube has more simplified structure and a lower PD value and can provide clear, plane and easily seeable images.

This invention is also characterized in that the shadow mask comprising a thin plate of an Elinvar alloy is fixed in such a manner that a constant stress may be applied to the shadow mask at ordinary temperature (20° C.).

Heretofore, even if a material having an extremely small linear expansion coefficient is selected as a material for the shadow mask, the size variation due to the thermal expansion cannot be inhibited to a level of zero, so long as temperatures to be employed widely range. According to this invention, the size variation due to the above-mentioned thermal expansion can be compensated for the strain variation caused by the stress variation which is applied to the material, thereby restraining the size variation resulting from temperature rise to a level of substantially zero.

DETAILED DESCRIPTION OF THE INVENTION

Figure 1:
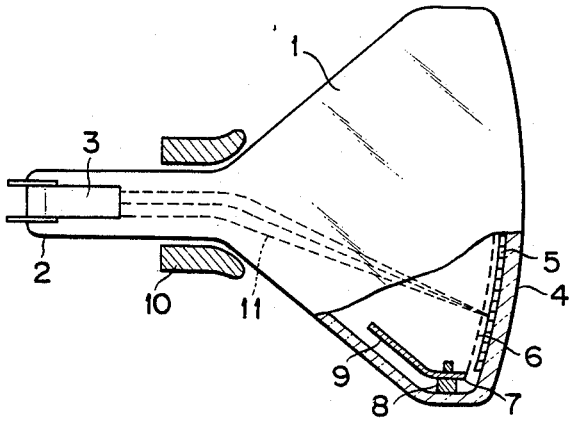
FIG.1 Prior Art
FIG. 1 is a schematic sectional view illustrating structure of a conventional image receiving tube.

Now, supposing stress $\sigma$ is uniformly applied to the shadow mask plate in its lengthwise direction and on condition that a value at 20° C. is regarded as a standard, a size variation of $\epsilon$ of the shadow mask in the lengthwise direction at a temperature T can be represented as follows:

$$\epsilon = \frac{\Delta l}{l} = \alpha(T - T_0) + \frac{\sigma}{E} \quad (1)$$

wherein $\Delta l$ is size variation, l is length of the shadow mask in its lengthwise direction, $\alpha$ is a linear expansion coefficient of a material for the shadow mask at a temperature T, $T_0$ is 20° C., and E is an elasticity coefficient of the material at the temperature T. In short, the first term in the right side of the formula (1) represents the size variation due to the thermal expansion, and the second term therein represents the strain due to the stress $\sigma$. After all, in order to obtain the constant variation $\epsilon$ in the formula (1), the size increment due to the temperature rise in the first term in the right side has to be equal to the strain decrement due to the stress decrease in the second term therein. In usual iron alloys, however both the linear expansion coefficient $\alpha$ and the elasticity coefficient E depend on temperatures, and thus it has been impossible to maintain the variation at a constant level at all temperatures within a certain temperature range. Hence, in this invention, much attention is paid to Elinvar alloys. This Elinvar alloy is an Fe-Ni-Cr alloy comprising 30 to 45% by weight of Ni and 3 to 15% by weight of Cr, and further comprising at least one of 0.5 to 4% by weight of Ti, 0.1 to 3% by weight of Al, 0 to 1% by weight of C, 0 to 5% by weight of Co, 0 to 12% by weight of Mo, 0 to 5% by weight of W, 0 to 4% by weight of Mn, 0 to 3% by weight of Si, 0 to 2% by weight of Be, 0 to 0.5% by weight of Cu, 0 to 0.1% by weight of S, 0 to 2.0% by weight of Nb and 0 to 2.0% by weight of Zr, the balance consisting essentially of Fe, its thermoelasticity coefficient being within the range of $\pm 20\times 10^{-6}$/°C. The above-mentioned thermoelasticity coefficient means the sum of a rate e of temperature change of the elasticity coefficient E and the thermal expansion coefficient $\alpha$.

The thermoelasticity coefficient is generally represented by TEC as follows:

$$TEC=2(e+\alpha)$$

wherein $\alpha=\Delta l/l\Delta T$ and $e=\Delta E/E\Delta T$.

In the Elinvar alloy, the thermal expansion coefficient $\alpha$ and the rate e of temperature change of the elasticity coefficient E are compensated for each other in the relation of plus and minus, so that TEC will become a value of approximately zero ($\pm 20\times 10^{-6}$/°C. or less), the length l will be unchanged in the case that the elasticity coefficient E is unchanged and the tensile strength is applied thereto, even if the temperature rises. This Elinvar alloy has two great features that (1) the thermal expansion coefficient is small and (2) the rate of temperature change of the elasticity coefficient is substantially zero.

Now suppose the length of the shadow mask in its lengthwise direction at a temperature T° C. is $L_0$, then the corresponding length to be defined w hen the shadow mask is fixed by applying a tension thereto so that the stress $\sigma$ may be given is $L_1$, and the elasticity coefficient at the temperature T° C. is $E_1$. The strain due to the stress $\sigma$ in the second term in the right side of the formula (1) can be represented as follows according to Hooke's law:

$$\sigma/E_1=(L_1-L_0)/L_0 \quad (2)$$

Then, the length of the shadow mask in its lengthwise direction at a temperature T+ΔT° C., when no stress is applied thereto, is $L_0(1+\alpha\Delta T)$. Now supposing the corresponding length to be defined when the shadow mask is fixed by applying stress $\sigma$ thereto at the temperature T+ΔT° C., is $L_2$, and the elasticity coefficient at the temperature T+ΔT° C. is $E_2$, the above-mentioned constant tensile stress can be represented as follows:

$$\sigma - \frac{L_2 - L_0(1+\alpha\Delta T)}{L_0(1+\alpha\Delta T)} E_2$$

Accordingly, the following formula will be established according to Hooke's law.

$$\frac{L_2 - L_0(1+\alpha\Delta T)}{L_0(1+\alpha\Delta T)} = \frac{\sigma - \frac{L_2 - L_0(1+\alpha\Delta T)}{L_0(1+\alpha\Delta T)} E_2}{E_2} \quad (3)$$

In the Elinvar alloy, the following formula is established:

$$E_2 = E_1(1+\epsilon\Delta T) \quad (4)$$

Thereby, the following formula can be obtained.

$$L_2 - L_1 = \frac{1}{2(1+\epsilon\Delta T)}[(\alpha\Delta T - 1 - 2\epsilon\Delta T)L_1 + \{1+(2\epsilon+\alpha)\Delta T + 2\alpha\epsilon\Delta T^2\}L_0] \quad (5)$$

In the formula (5), when the first term and second term in the right side thereof are equal to each other to give the following formula (6), the value of $L_1$ becomes equal to value of $L_2$.

$$\frac{L_1}{L_0} = \frac{1+(2\epsilon+\alpha)\Delta T + 2\alpha\epsilon\Delta T^2}{1+2\epsilon\Delta T - \alpha\Delta T} \quad (6)$$

This shows that the length $L_1$ of the shadow mask in its lengthwise direction at a temperature T° C. is equal to the length $L_2$ in the lengthwise direction at a temperature T+ΔT° C. when the shadow mask is fixed by applying tensile stress $\sigma$ thereto.

At the same time, the value $\sigma$ is represented as follows:

$$\sigma = \frac{2\alpha\Delta TE_1}{1+2\epsilon\Delta T - \alpha\Delta T} \quad (7)$$

Then, a maximum value of tensile strength will be calculated. The value of $\sigma$ which makes $L_1$ equal to $L_2$ can be represented as follows according to the formula (7).

$$\sigma = \frac{2\alpha\Delta TE_1}{1+2\epsilon\Delta T - \alpha\Delta T} \approx \frac{2\alpha\Delta TE_1}{1}$$

In the Elinvar alloy, the maximum value of $\alpha$ is $10^{-5}$/°C. The maximum value of $E_1$ is 20,000 kg/mm$^2$. Accordingly, when the temperature of the shadow mask rises from 20° C. to 90° C., the value $\sigma$ is as follows:

$$\sigma \approx 2\times 10^{-5}\times 70\times 20{,}000 = 28 \text{ kg/mm}^2$$

Since, the maximum value of proof strength is about 140 kg/mm$^2$, the maximum value of the tensile stress can be about one-fifth of the maximum value of the proof strength.

Next, reference will be made to functions of components constituting the Elinvar alloy of this invention and reasons for limitation on amounts thereof.

Nickel (Ni) is the most effective element to maintain permanent-elasticity properties, and when its amount is less than 30.0% by weight and is more than 45% by weight, the desired effective permanent-elasticity properties cannot be obtained.

Cobalt (Co) is also an element effective to retain the permanent-elasticity like nickel, and above all, because of being capable of raising the magnetic transformation point of the alloy, the element cobalt can contribute to enlarge a temperature range for the permanent-elasticity properties. When the amount of cobalt to be added is in excess of 5.0% by weight, any sufficient effect cannot be obtained.

Chromium (Cr) is also an element effective to maintain the permanent-elasticity properties like nickel, and when its amount is less than 3.0% by weight and more than 15% by weight, any sufficient permanent-elasticity properties cannot be obtained. Further, the addition of chromium is effective also in view of anticorrosion of the alloy.

Titanium (Ti) is an element effective to improve the strength of the alloy by being deposited when subjected to an aging treatment, and when its amount is less than 0.5% by weight, any sufficient strength cannot be obtained; when the amount is more than 4.0% by weight, and permanent-elasticity properties of the alloy will deteriorate.

Aluminum (Al) is an element effective to heighten a strength of the alloy like titanium, and when its amount is less than 0.1% by weight, any sufficiently improved strength cannot be obtained; when the amount is more than 3.0% by weight, the permanent-elasticity properties of the alloy will decline.

The reason why the amount of molybdenum (Mo) is set to 12% by weight or less is that when its amount is more than this level, the permanent-elasticity properties of the alloy cannot be obtained, and its anticorrosion and its cold workability will become poor.

The reason why the amount of tungsten (W) is set to 5% by weight or less is that when its amount is more than this level, the permanent-elasticity properties of the alloy cannot be obtained and its hardness will deteriorate, and its cold workability will also become poor.

Manganese (Mn) and silicon (Si) are used for the improvement of workability and deoxidation, and when they are added in amounts of 4% by weight or less and 3% by weight or less, respectively, the aforesaid purposes can be accomplished.

Beryllium (Be) and copper (Cu) are elements for heightening the hardness of the alloy, and their amounts of at most 2% by weight and at most 0.5% by weight, respectively, can accomplish this purpose.

Zirconium (Zr) and niobium (Nb) are elements which can contribute to the improvement of alloy strength when used together with titanium and aluminum, and if the amounts thereof are in excess of 2.0% by weight respectively, the permanent-elasticity properties will deteriorate.

Carbon (C) is an element effective to heighten the strength of the alloy by forming deposites with chromium and titanium and dispersing the deposites in the alloy. Further, carbon is also an element effective to maintain the permanent-elasticity properties, but if the amount thereof exceeds 1.5% by weight, effective permanent-elasticity properties can not be obtained.

Sulfur (S) is an impurity, and its amount is preferred to be as small as possible.

In the above-mentioned components, it is preferred that the alloy of this invention comprises Ti, Al, Co, Zr, Cr and C.

The reason why the thermoelasticity coefficient is set to be within the range of $\pm 20\times 10^{-6}/°C.$ is that when the coefficient is more than $\pm 20\times 10^{-6}/°C.$, the thermal expansion will occur and the elasticity coefficient will increase with a temperature rise, and for example, displacement such as position deviation of electron openings in the shadow mask will be great, even if a tensile strength is applied thereto. Practically, the thermoelasticity coefficient is preferably within the range of $\pm 15\times 10^{-6}/°C.$ The in-tube parts according to this invention can be manufactured, for example, in the following procedure.

A plate which has been obtained by subjecting to a hot rolling treatment an alloy material comprising certain components is cold-rolled at a rolling rate of 50% or more, preferably about 70 to about 95%, and is then annealed at an elevated temperature of a recrystallization temperature or more, preferably at a temperature of 700° C. or more to prepare, for example, a material for the shadow mask. Afterward, the material is shaped into a flat form by a leveller, or is subjected to an adjusting rolling treatment at a rolling rate of 40% or less, preferably 15% or less, and electron openings are provided therein by a usual photoetching technique.

With regard to the shadow mask manufactured in the above-mentioned manner, as a F-parameter (fraction-parameter) of (100) face of the mask surface is 0.35 or more, preferably 0.42 or more, as a result, it is extremely excellent in etching properties and the like.

In this connection, a flat shadow mask was experimentally prepared using the Elinvar alloy comprising 37% by weight of Ni and 9% by weight of Cr and having a thermoelasticity coefficient of $-6\times 10^{-6}/°C.$, and an image receiving tube was constructed with use of this shadow mask. A PD value of the thus manufactured tube which was measured for 3 minutes was as small as 20 μm. On the contrary, another shadow mask was experimentally made from a conventional amber and was then annealed in hydrogen at 800° C. and oxidized with water vapor to form a black oxide membrane thereon. Another image display tube was built using the thus manufactured shadow mask. PD values of this tube which was measured for 3 minutes was as large as 120 to 130 μm. The above-mentioned black oxide membrane was provided to emit radiant heat and to thereby lower the PD values, and if necessary, such a black membrane may be formed on the alloy of the present invention.

When the image display tube is made by using in-tube parts such as the shadow mask comprising the alloy of this invention and disposing them with a tension applied thereto, this tube can provide a clear and extremely fine high-quality image. In addition thereto, the image can be effectively obtained on which the color deviation is small even at four corners of a screen, and color change can be inhibited even on a white image for a long period of time. In particular, since it is possible to form the flat screen, straight lines in the image can be inhibited from curving, and the clear high-contrast image can be effectively displayed thereon. Further, since being high in strength, the in-tube parts are not vibrated influentially by low-frequency acoustic wave from a speaker adjacently disposed, and can sufficiently withstand mechanical shock and the like to provide the image without the so-called fluctuation.

Moreover, the shadow mask can be simply fixed involving the application of tension. That is, since no variation due to thermal expansion appears, a bimetal which has been conventionally used is not necessary. Therefore, the image display tube can be simplified in structure, which fact assures a high fixation accuracy of the shadow mask. Furthermore, since the shadow mask can be shaped into a complete flat form, the flat image receiving tube can be provided. In addition thereto, a size variation of the shadow mask due to a temperature change scarcely occurs, therefore the image receiving tube capable of providing the stable image can be manufactured.

Now, this invention will be described in greater detail with reference to examples.

EXAMPLE 1

In the first place, an ingot of an alloy containing 43% by weight of Ni and Fe as main components as well as 5% by weight of Cr and 3% by weight of Ti was prepared, and this ingot was then hot forged at 1,250° C. Afterward, the material was hot rolled at 1,100° C. and was further rolled twice to form a thin strip having thickness of 0.8 mm. The strip was then bright-annealed in hydrogen at 1,050° C. and was further cold-rolled at a rolling rate of 80% to form the thin strip having wall thickness of 0.16 mm. Moreover, the gright annealing was carried out in hydrogen at 1,000° C., and final adjustment rolling and final annealing at 620° C. were then accomplished to prepare a material for the shadow mask having wall thickness of 0.13 mm and thermoelasticity coefficient of $6.3\times10^{-6}$.

Afterward, this plate material was coated with a photoresist and was then dried. Films which were formed with slot- or dot-shaped standard patterns were caused to closely adhere to both the surfaces of the plate material and the above-mentioned photoresist was exposed to light and then developed. By means of this development, unexposed portions of the photoresist were dissolved and removed. The remaining photoresist was subjected to a burning treatment in order to be cured, and an etching treatment was then carried out with a ferric chloride solution. Afterward, the still remaining resist was removed with hot alkali to prepared a flat mask.

Afterward, this flat material was washed and sheared, and was then annealed at $10^{-4}$ torr at 1,000° C., followed by press work to manufacture a shadow mask.

The thermal expansion coefficient $\alpha$ of the above-mentioned alloy is $7.5\times10^{-6}$ and temperature coefficient of the elasticity coefficient is $\epsilon\approx0$. Now, provided the length $L_0$ of the shadow mask in its lengthwise direction is 300 mm, the size variation $L_1-L_0$ which is caused by the thermal coefficient till T has reached 20° to 90° C. is represented as follows according to the formula (6):

$$L_1/L_0=1.0011$$

Accordingly, $$L_1-L_0=0.33.$$

Figure 2:
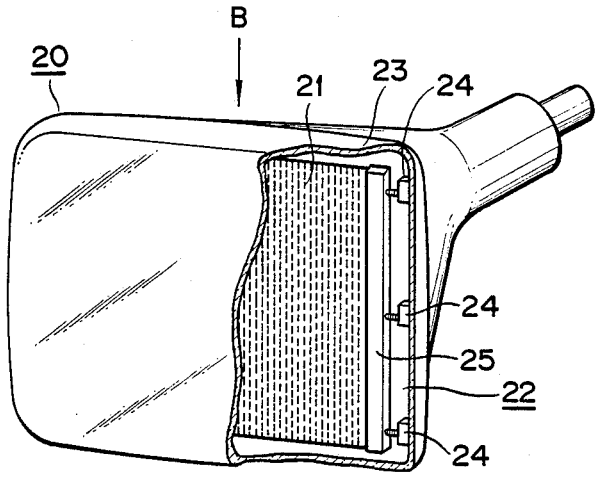
FIG. 2 is a partially cutaway perspective view of an image receiving tube according to one embodiment of this invention.
Figure 3:
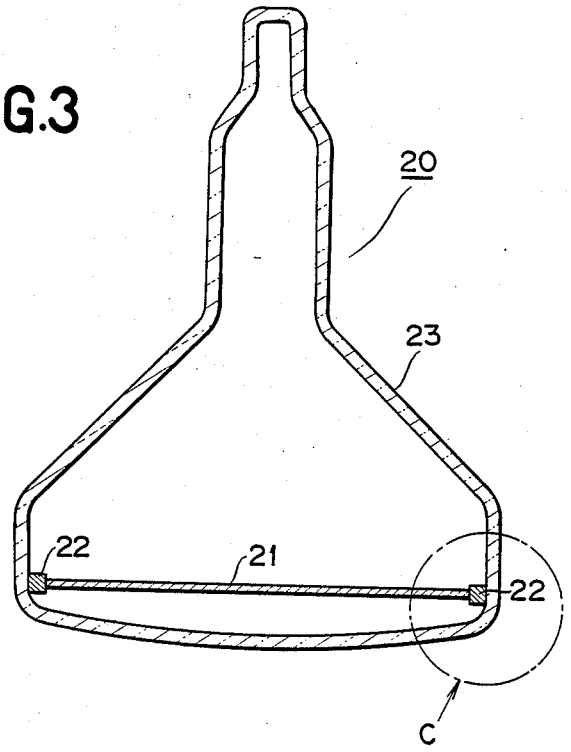
FIG. 3 is a schematic sectional view of the image receiving tube according to this invention, viewed from the direction of the arrow B in FIG. 2.
Figure 4:
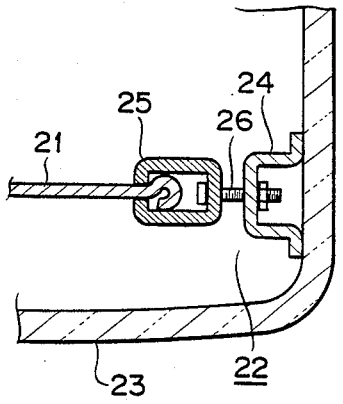
FIG. 4 is a sectional view illustrating in detail the portion C in FIG. 3.

Thus, after the shadow mask has been fixed on a tube, a tension is applied to the shadow mask so that the strain of about 0.33 mm may be generated at 20° C. An exemplary structure of a color television image receiving tube which enables such a fixation is shown in FIGS. 2 to 4. Referring now to these drawings, in a color television image receiving tube 20, a shadow mask 21 is supported on the opposite shorter edges by supporting means 22, which are each composed of fixing members 24 secured at three upper, middle and lower positions on the inside wall of the tube 23, a supporting frame 25 for supporting the shadow mask 21 all over the shorter edges thereof, and bolts 26 for connecting the fixing members 24 to the supporting frame 25. Each supporting frame 25 comprises a pipe having a rectangular shape in a sectional view and one slit extending in its lengthwise direction. The above-mentioned shadow mask 21 is pressed on the opposite shorter edges into the form of a hook, and each hook is then received in the pipe body of the supporting frame 25 through the slit thereof, whereby the shadow mask 21 is supported by the supporting frames 25.

In the color television image display tube thus constituted, the above-mentioned strain is applied to the shadow mask 21 by suitably adjusting a fastening degree of the bolts 26.

Thus, since the value $E_1$ of this material is 180,000 kg/mm$^2$, the stress $\sigma$ against the shadow mask on the basis of the above-mentioned strain of 0.33 mm is represented as follows according to the formula (7):

$$\begin{aligned}\sigma &= 2\alpha\times\Delta T\times E_1\\ &= 2\times7.5\times10^{-6}\times70\times180{,}000\\ &= 18.9\ \text{kg/mm}^2\end{aligned}$$

Since this value is much smaller than the maximum allowable stress, 127 Kg/mm$^2$, of the Elinvar alloy having the above-mentioned components, the shadow mask can escape from plastic deformation.

According to the example just described, the size variation of the shadow mask in its lengthwise direction due to temperature rise does not occur at all. Therefore, the above-mentioned effects can be obtained sufficiently. Needless to say, the aforesaid constitution can be applied similarly to other cathode-ray tubes.

Fluorescent surface was formed in a usual manner, i.e., by coating a fluorescent surface material with red, blue and green fluorescent substances in accord with openings in the shadow mask, depositing aluminum thereon and carrying out a dag coating. An inner shield was then fixed to the thus prepared fluorescent surface so as to connect this panel to an outer surrounder funnel having an electron gun at the rear thereof, and the funnel was afterward evacuated in order to obtain a vacuum state therein, thereby manufacturing the image receiving tube.

In this example, reference to the size variation in the vertical direction of the shadow mask has been omitted, but it is apparent that the concept of this invention permits inhibiting size variations in four directions, i.e., upward, downward, right and left directions.

Further, the above-mentioned supporting means 22 for the shadow mask is not to be limited to this type above. Any modified supporting means can be accepted so long as it possesses structure which can securely mount the shadow mask having a constant length.

EXAMPLE 2

A flat mask was prepared using an alloy ingot comprising 36% of Ni and Fe as main components as well as 9% by weight of Cr in the same manner as in Example 1 described above. The prepared flat mask was then annealed in hydrogen at 1,100° C. to manufacture a shadow mask, and a color receiving tube was completed using this shadow mask.

In this alloy, supposing $\alpha$ is $10\times10^{-6}$/°C., is 0 to $2.5\times10^{-5}$/°C., $E_1$ is 18,300 kg/mm$^2$ and temperature is changed from 20° C. to 90° C., and the value of stress $\sigma$ becomes 25.6 kg/mm$^2$ according to the formula (7). Accordingly, no variation of opening positions due to temperature rise was perceived when the shadow mask was fixed by applying the tensile strength which cause the above stress.

EXAMPLE 3

A flat mask was prepared using an alloy ingot comprising 42% by weight of Ni and Fe as main components as well as 5% by weight of Cr, 1.0% by weight of Ti, 0.5% by weight of Al, 1.5% by weight of Zr and 1% by weight of Co in the same manner as in Example 1 described above. The prepared flat mask was then annealed in hydrogen at 1,000° C. to manufacture a shadow mask, and a color receiving atube was completed using this shadow mask.

EXAMPLE 4

A shadow mask was prepared using an alloy of Elinvar comprising 36% by weight of Ni, 12% by weight of Cr, 2% by weight of W, 1.5% by weight of Mn, 1.5% by weight of S, 0.8% by weight of C and a balance which consists essentially of Fe. In this alloy, $\alpha$ is $8\times10^{-6}$/°C., $\epsilon$ is $\pm0.3\times10^{-5}$/°C., $E_1$ is 8,000 kg/mm$^2$ and $\Delta T$ is 70° C. Accordingly, the value of $\sigma$ is 8.96 kg/mm$^2$ according to the formula (7). When the tensile fixing strength to be applied to this shadow mask was same as the above value of $\sigma$, no variation of opening positions was observed.

EXAMPLE 5

A shadow mask was prepared using an alloy comprising 38% by weight of Ni, 11% by weight of Cr, 0.4% by weight of C and a balance which consists essentially of Fe. In this alloy, $\alpha$ is $10\times10^{-6}$/°C., $\epsilon$ is $-1.5\times10^{-5}$ to 0/°C., $E_1$ is 18,200 kg/mm$^2$ and $\Delta T$ is 70° C. Accordingly, the value of $\sigma$ is 25.6 kg/mm$^2$ according to the formula (7). When the tensile fixing strength to be applied to this shadow mask was same as the above value of $\sigma$, no color deviation due to temperature rise was perceived.

EXAMPLE 6

A shadow mask was prepared using an alloy comprising 36% by weight of Ni, 7.5% by weight of Cr, 0.5% by weight of Mo, 0.5% by weight of Mn, 0.5% by weight of Si, 0.2% by weight of Cu, 0.1% by weight of C and a balance which consists essentially of Fe. In this alloy, $\alpha$ is $7.2\times10^{-6}$/°C., $\epsilon$ is $-3.6\times10^{-5}$ to $+2.7\times10^{-5}$/°C., $E_1$ is 18,300 kg/mm$^2$ and $\Delta T$ is 70° C. Accordingly, the value of $\sigma$ is 18.4 kg/mm$^2$ in the same manner as in Example 1. When a tensile fixing strength same as the above value of $\sigma$ was applied to the shadow mask, $L_1$ was made equal to $L_2$.

EXAMPLE 7

A shadow mask was completed using an alloy comprising 43% by weight of Ni, 5% by weight of Cr, 0.6% by weight of Mn, 0.5% by weight of Si, 2.75% by weight of Ti, 0.3% by weight of Al, 0.04% by weight of C, 0.35% by weight of Co and a balance which consists essentially of Fe. In this alloy, $\alpha$ is $6.5\times10^{-6}$/°C., $\epsilon$ is 0, $E_1$ is 18,000 kg/mm$^2$ and $\Delta T$ is 70° C. Accordingly, the value of $\sigma$ is 8.4 kg/mm$^2$ according to the formula (7). When a tensile fixing strength to be applied to this shadow mask was same as the above value of $\sigma$, $L_1$ was made equal to $L_2$.

EXAMPLE 8

A shadow mask was completed using an alloy comprising 42% by weight of Ni, 5.32% by weight of Cr, 0.52% by weight of Mn, 0.33% by weight of Si, 2.46% by weight of Ti, 0.46% by weight of Al, 0.05% by weight of Cu, 0.007% by weight of S, 0.02% by weight of C, and a balance which consists essentially of Fe. In this alloy, $\alpha$ is $8.1\times10^{-6}$/°C., $\epsilon$ is $\pm1.8\times10^{-5}$/°C., $E_1$ is 19,000 kg/mm$^2$ and $\Delta T$ is 70° C. Accordingly, the value of $\sigma$ is 21.5 kg/mm$^2$ according to the formula (7). When a tensile fixing strength to be applied to this shadow mask was same as the above value of $\sigma$, $L_1$ was made equal to $L_2$.

EXAMPLE 9

A shadow mask was completed using an alloy comprising 42% by weight of Ni, 5.5% by weight of Cr, 2.5% by weight of Ti and a balance which consists essentially of Fe. In this alloy, $\alpha$ is $8\times10^{-6}$/°C., $\epsilon$ is $\pm1.0\times10^{-5}$/°C., $E_1$ is 19,500 kg/mm$^2$ and $\Delta T$ is 70° C. Accordingly, the value of $\sigma$ is 21.9 kg/mm$^2$ according to the formula (7). When a tensile fixing strength to be applied to this shadow mask was same as the above value of $\sigma$, $L_1$ was made equal to $L_2$.

EXAMPLE 10

A shadow mask was completed using an alloy comprising 36% by weight of Ni, 8% by weight of Cr, 1% by weight of Ti, 1% by weight of Be and a balance which consists essentially of Fe. In this alloy, $\alpha$ is $7.5\times10^{-6}$/°C., $\epsilon$ is $\pm2.5\times10^{-5}$/°C., $E_1$ is 19,000 kg/mm$^2$ and $\Delta T$ is 70° C. Accordingly, the value of $\sigma$ is 20.0 kg/mm$^2$ according to the formula (7). When a tensile fixing strength to be applied to this shadow mask was same as the above value of $\sigma$, $L_1$ was made equal to $L_2$.

The color image display tubes manufactured in Examples 1 to 10 were tested for PD values at four corners thereof. As a result, it was found that PD value of the tubes according to the respective examples had as small values as about 20 $\mu$m for 3 minutes, whereas those of conventional tubes were within the range of 120 to 130 $\mu$m for 3 minutes. Further, in the case of these image receiving tubes, the period from the occurrence of PD to the return of an original normal condition was about a half (about 2 minutes and 30 seconds) of that of the conventional one. In the color image display tubes according to this invention, no color deviation was perceived all over the screen and thus a high-quality image was obtained.

Hereinbefore, the manufacture of the shadow mask has been described, but the in-tube parts such as an inner shield and a frame can similarly be prepared and the color image display tubes can also be manufactured from these parts. It should be noted that this invention can be variously modified and practiced without deviating from the gist thereof.

We claim:

1. An image display tube comprising:

a shadow mask comprising an alloy consisting essentially of (i) at least one of 0.5 to 4% by weight of Ti, 0.1 to 3.0% by weight of Al, 0 to 1% by weight of C, 0 to 5% by weight of Co, 0 to 12% by weight of Mo, 0 to 5% by weight of W, 0 to 4% by weight of Mn, 0 to 3% by weight of Si, 0 to 2% by weight of Be, 0 to 0.5% by weight of Cu, 0 to 0.1% by weight of S, 0 to 2.5% by weight of Nb and 0 to 2.0% by weight of Zr;

(ii) 30 to 45% by weight of Ni;

(iii) 3 to 15% by weight of Cr; and (iv) a balance consisting essentially of Fe; and means for mounting said shadow mask in the image display tube under a predetermined amount of tensile stress;

wherein said alloy has a thermoelasticity coefficient comprising a value within the range of $\pm 20\times 10^{-6}/°C$.

2. The image display tube according to claim 1, wherein said thermoelasticity coefficient comprises a value within the range of $\pm 15\times 10^{-6}/°$.

3. The image display tube according to claim 1, wherein said predetermined tensile stress comprises about one-fifth or less of the proof strength of said alloy.

4. The image display tube according to claim 1, wherein said alloy comprises 30 to 45% by weight of Ni, 3 to 15% by weight of Cr, 0.5 to 4% by weight of Ti, 0.1 to 3.0% by weight of Al, 0 to 1% by weight of C, 0 to 5% by weight of Co, 0 to 2.0% by weight of Zr and a balance consisting essentially of Fe.

5. The image display tube according to claim 3, wherein said predetermined tensile stress comprises a value of from about 8 $kg/mm^2$ to about 28 $kg/mm^2$.

6. The image display tube according to claim 1, wherein said predetermined tensile stress comprises an amount sufficient to prevent an increase in the length of the shadow mask upon an increase in temperature.

7. The image display tube according to claim 1, wherein said tube comprises a color television picture tube.

8. The image display tube according to claim 7, wherein said picture tube is rectangular and said tensile strength is applied along the horizontal direction of the tube.

9. A color image display tube, comprising:

a vacuum tube comprising a face portion;

an electron gun mounted in the vacuum tube;

a deflecting device for deflecting electron beams from the electron gun;

fluorescent substances on the inner surface of the face portion;

a shadow mask adjacent to the inner surface comprising an alloy consisting essentially of (i) at least one of 0.5 to 4% by weight of Ti, 0.1 to 3.0% by weight of Al, 0 to 1% by weight of C, 0 to 5% by weight of Co, 0 to 12% by weight of Mo, 0 to 5% by weight of W, 0 to 4% by weight of Mn, 0 to 3% by weight of Si, 0 to 2% by weight of Be, 0 to 0.5% by weight of Cu, 0 to 0.1% by weight of S, 0 to 2.5% by weight of Nb and 0 to 2.0% by weight of Zr;

(ii) 30 to 45% by weight of Ni;

(iii) 3 to 15% by weight of Cr; and (iv) a balance consisting essentially of Fe; and supporting means for mounting said shadow mask in the image display tube comprising tension applying means to compensate for strain generated by heating of the shadow mask during operation of the image display tube.

10. An image display tube according to claim 1, wherein said tensile stress is calculated according to the following formula $$\sigma = 2\alpha \times \Delta T \times E_1.$$

11. An image display tube according to claim 9, wherein said tension applying means applies a tensile stress calculated according to the following formula $$\sigma = 2\alpha \times \Delta T \times E_1.$$

* * * * *